United States Patent [19]

Cho

[11] Patent Number: 4,690,401

[45] Date of Patent: Sep. 1, 1987

[54] CIRCULAR SPORTING ARTICLE

[75] Inventor: Shoji Cho, Osaka, Japan

[73] Assignee: Life Environment Research Laboratories, Osaka, Japan

[21] Appl. No.: 781,481

[22] Filed: Sep. 30, 1985

[30] Foreign Application Priority Data

Sep. 29, 1984 [JP] Japan ..... 59-147599

[51] Int. Cl.[4] ..... A63B 21/02

[52] U.S. Cl. ..... 272/137; 272/135; 267/152

[58] Field of Search ..... 272/93, 135, 137, 141, 272/142, 143, 68; 267/30, 152

[56] References Cited

U.S. PATENT DOCUMENTS 3,219,342 11/1965 Melchiona ..... 272/68
3,822,870 7/1974 Champleboux et al. ..... 267/152
3,958,803 5/1976 Geisselbrecht ..... 272/135
4,428,577 1/1984 Weingardt ..... 272/143 X

FOREIGN PATENT DOCUMENTS 372309 3/1923 Fed. Rep. of Germany ..... 272/135

*Primary Examiner*—Richard J. Apley
*Assistant Examiner*—Robert W. Bahr
*Attorney, Agent, or Firm*—Stiefel, Gross, Kurland & Pavane

[57] ABSTRACT

A circular sporting article comprising a core material in a ring shape made of a long and narrow strip of spring steel and a flexible covering material to cover said circular core material and having an overall diameter approximately corresponding to the shoulder length of a user and a sectional diameter which can be easily grasped by a user, which can be used by adults or children for improving their arm or leg strength or grasping power.

11 Claims, 21 Drawing Figures

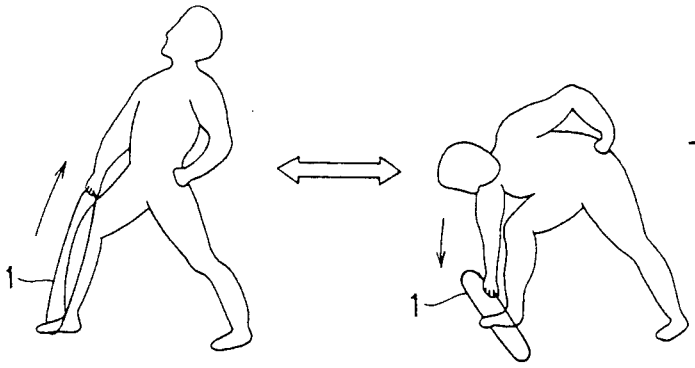
Fig. 12.
Fig. 11.
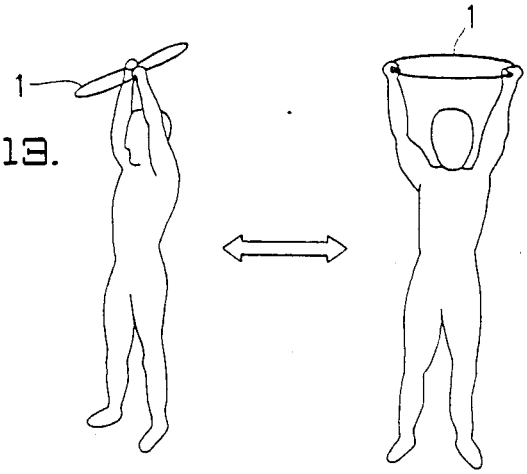
Fig. 13.
Fig. 15.
Fig. 14.
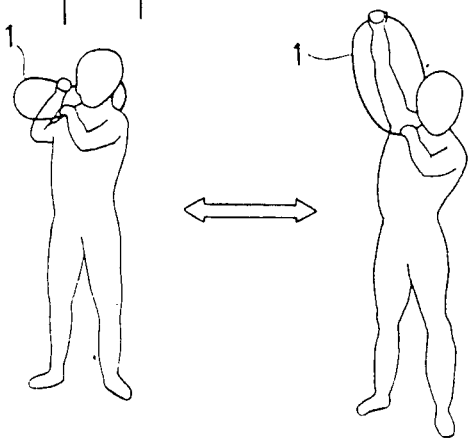
Fig. 16.

CIRCULAR SPORTING ARTICLE

BACKGROUND OF THE INVENTION

1. Field of the Invention

This invention relates to circular sporting article used for improving physical strength and health of the human being.

2. Description of the Prior Art

The conventional sporting articles to build up the muscles include a barbell, a pair of iron dumbbells, a chest expander and other equipment worked by means of a spring. However, some of them are too heavy and dangerous, require skill to some degree, occupy a good deal of space, need a place to exercise, or are one-sided in their effect.

SUMMARY OF THE INVENTION

This invention relates to a circular sporting article comprising a core material in a ring shape made of a long and narrow strip of spring steel and a flexible covering material to cover said circular core material and having an overall diameter approximately corresponding to the shoulder length of a user and a sectional diameter which can be easily grasped by a user.

It is an object of this invention to provide sporting article which anyone can use easily and safely.

Another object of the invention is to provide sporting article of simple structure and a low price.

A further object of the present invention is to provide a sporting article that improves grasping power as well as arm and leg strength and other muscles of the body.

BRIEF DESCRIPTION OF THE DRAWINGS

FIGS. 9 through 19 show how to use the circular sporting goods of this invention.

DESCRIPTION OF THE PREFERRED EMBODIMENT

Figure 1:
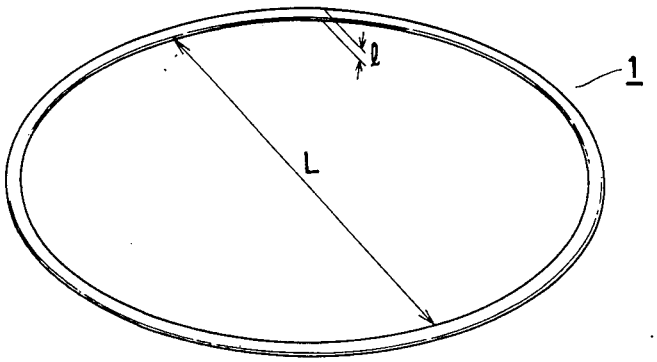
FIG. 1 is a perspective view of an embodiment of circular sporting article of this invention.

Core material (hoop) 3 used in this invention is required to display proper repulsive power when circular sporting article 1 is used. Proper repulsive power means repulsive power that requires a moderate amount of exercise and serves to increase muscular strength when a user uses the circular sporting article 1. This required repulsive power varies according to adults and children who use it and ranges from 3 to 7 kg. The desirable size is decided by proper selection and combination of the composition and thickness of spring steel 2 which forms the core material 3 and the circular composition of the core material 3.

Covering material 4 which covers the core material 3 protects hands and other parts of the body when the circular sporting article 1 is used. The covering material 4 must have flexibility so that it can be transformed with the core material 3. For these reasons the covering material 4 is made of rubber or synthetic resin.

FIG. 1 shows the whole composition of the circular sporting article 1 of this invention. Diameter L is 30–60 cm which correspond to the shoulder length of a user. Namely, 30–50 cm will be suitable for school children and junior high school students and 50–60 cm will be suitable for those older than them. Sectional diameter of the covering material is 10–20 mm so that it can easily be grasped by a hand. For children, it is made thinner, and for adults it is made thicker.

Figure 2:
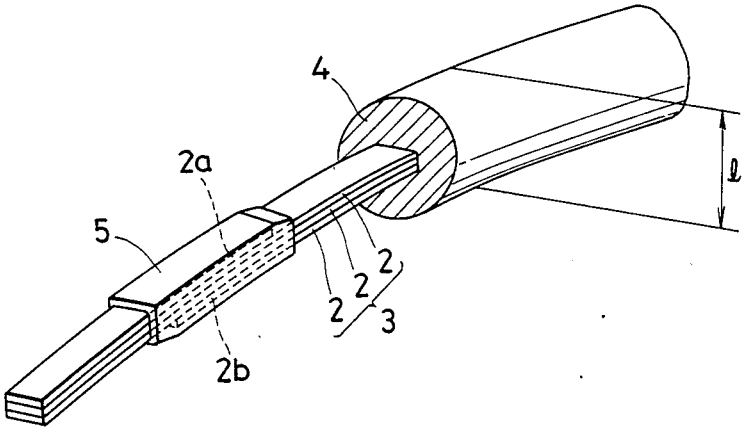
FIG. 2 is a perspective view of the main part showing the inner structure of the embodiment shown in FIG. 1.

As shown in FIG. 2, the circular sporting article 1 is composed of the core material 3 which is made up of the spring steel 2 and the covering material 4 which covers the core material 3 entirely.

In more detail, used for the spring steel 2 which forms the core material 3 is, for example, oil-tempered SWRH72A spring steel (chemical components: carbon 0.69–0.76%, silicon 0.15–0.35%, manganese 0.30–0.90%, phosphorus less than 0.03%, sulfur less than 0.03%) specified by the Japanese Industrial Standards (JIS) G 3506, and the shape is formed in a flat, long, narrow strip.

Figure 3:
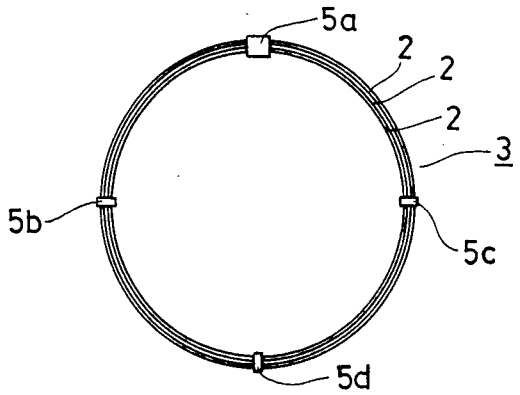
FIG. 3 is a plan view of an embodiment of core material used in this invention.

The core material 3 is made up of the spring steel 2 in a ring shape, wound concentrically in three layers, as shown in FIG. 3. Four metal fittings 5*a*, 5*b*, 5*c* and 5*d* are used to keep core material 3 in a circular form.

The metal fitting 5*a* fastens and fixes the 4-layer part of the spring steel 2 where both ends 2*a* and 2*b* of the spring steel 2 are positioned up and down as shown in FIG. 2. Contrary to this, other metal fittings 5*b*, 5*c* 5*d* are wound loosely to prevent irregularity of the 3-layer part of the spring steel 2. Therefore, each layer of spring steel 2 is slidable with respect to these metal fittings 5*b*, 5*c* and 5*d*. Each layer of spring steel 2 is also slidable with respect to one another. As a result, when force is applied to the core material 3 and the circular sporting article 1 is transformed as shown in FIG. 4, the spring steel 2 slides properly and there occurs no distortion of the spring steel 2 located inside.

Figure 4:
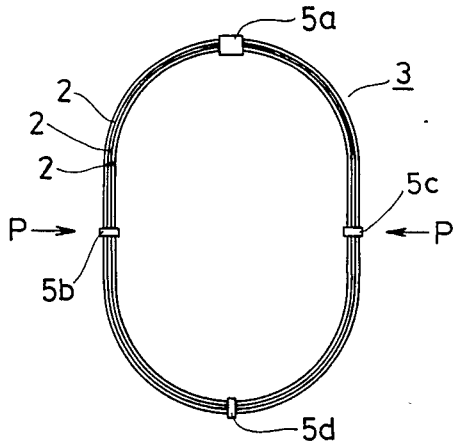
FIG. 4 is a plan view of the embodiment shown in FIG. 3 in a transformed shape.
Figure 5:
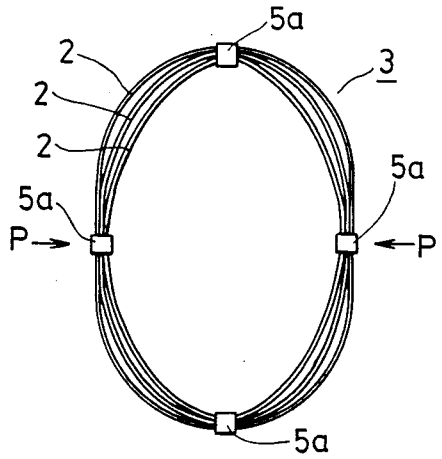
FIG. 5 is a plan view showing an unfavorable embodiment which corresponds to FIG. 4.

If all the metal fittings are fastened to fix the spring steel 2 like the metal fitting 5*a*, when the same force as that given in FIG. 4 is applied to the circular sporting article 1, the 2-layer spring steel 2 located inside is distorted as shown in FIG. 5. This distortion may cause damage to the covering material 4 which surrounds the spring steel 2. In addition, it is impossible to get the expected repulsive power if any distortion or damage happens.

It is necessary that the circular sporting article 1 can be grasped by a hand as mentioned above. The sectional diameter of the covering material 4 which covers the spring steel 2 must be 10–20 mm. In view of this, in case that the core material 3 is composed of three layers, the sectional dimensions of the spring steel 2 must be approximately 1 mm by 6 mm.

For the covering material 4, synthetic resin and rubber are used. In the case of synthetic resin, polyvinyl chloride resin which is semi-rigid and has some elasticity is used for example.

The use of rubber will be described in detail.

Compound rubber of natural rubber and synthetic rubber composed of nitrile butadiene rubber, ethylene propylene rubber and styrene butadiene rubber is used and it is combined with the additives such as a vulcanizing agent, vulcanization accelerator, weatherproof agent, pigment and filler at the ratio of 1 to 1 and formed.

An example of physical properties of the covering material 4 formed by the use of the above-mentioned rubber materials is as follows:

1. Hardness: HS 50°-55° (JIS)
2. Tensile strength: 120 kg/cm$^2$
3. Elongation percentage: 200%
4. Tear strength: 20 kg/cm$^2$
5. Age resistance and durability (Test pieces were left outdoors for a year.)
   (a) Tensile strength change rate: Within −30%
   (b) Elongation percentage change rate: Within −50%
6. Hardness change rate: Within +15% (Test pieces were left outdoors for six months.)

The manufacture of this invention will be explained simply.

Figure 6:
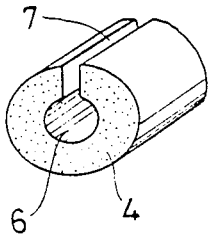
FIGS. 6, 7 and 8 show the manufacturing processes in order.
Figure 7:
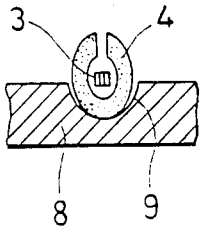
Figure 8:
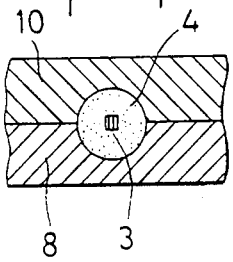

First of all, the covering material 4 as shown in FIG. 6 is manufactured through extrusion. A space 6 is formed in this covering material 4 for the core material 3 to be put in it later. One side of the space 6 has continuous opening 7. The covering material 4 is set in a concave groove 9 of a lower mold 8 so that the whole covering material forms a circular shape, and said core material 3 coated with mold releasing agent is put in the covering material 4 as shown in FIG. 7. Then an upper mold 10 is set as shown in FIG. 8. In case that the covering material 4 is made of the above-mentioned rubber for example, the mold is heated at 160° C. and a pressure of 200 kg is applied to the upper mold 10 with a press for seven minutes to form the covering material 4 through hardening.

By putting the core material 3 coated with mold releasing agent in the covering material 4 in the above-mentioned production process, the spring steel 2 becomes slidable in the covering material 4 after forming.

How to use the circular sporting article 1 of this invention will be explained simply.

Figure 9:
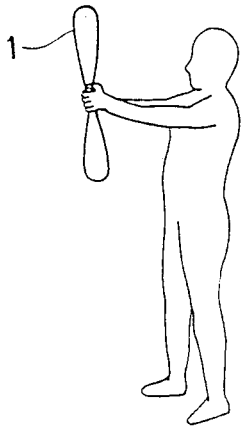
Figure 10:
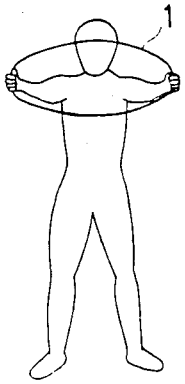
Figure 17:
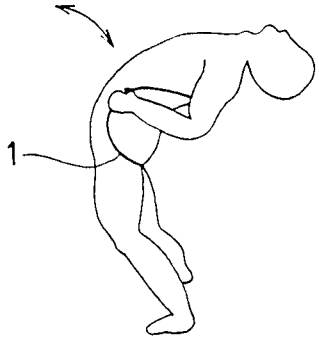

The most general use is, as shown in FIGS. 9 and 10, to compress and pull the circular sporting article 1 inward and outward respectively by both hands with both arms stretched out forward and to repeat these movements in concert with the restoring movement of the circular sporting article 1.

The pulling movement increases the back muscle and the compressing movement increases the arm and chest muscles.

Another use is shown in FIGS. 11 and 12. One end of the circular sporting article 1 is caught by the sole of a foot and it is repeatedly pulled and compressed by one hand or both hands. This strengthens the abdominal and arm muscles.

Furthermore, the circular sporting article 1 can be used in various ways to develop and stretch muscular strength of necessary parts of the body as shown in FIGS. 13 to 17.

Figure 18:
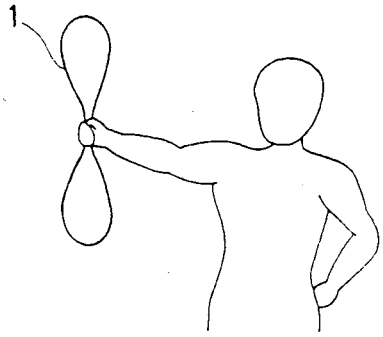
Figure 19:
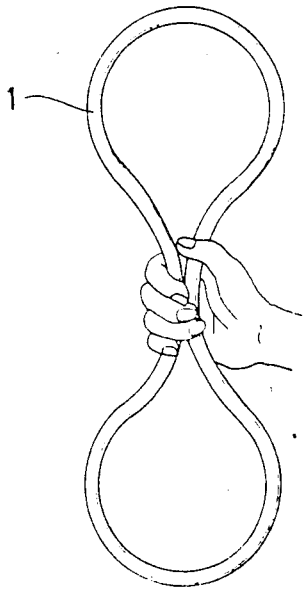

It can also be used to build up grasping power with the method as shown in FIGS. 18 and 19.

In every use mentioned above, the circular sporting article 1 did not twist in three dimensions because the core material 3 is composed of the long, narrow strip of spring steel 2 which is assembled in a circular shape. Also, because the layers of spring steel 2 slid properly without distortion in the covering material 4, they did not cause breakage of the covering material 4.

Next, the dimensions at the time of transformation of the circular sporting article 1 of this invention and the relationship among the overall diameter D, the sectional composition of the spring steel 2 used and repulsive power (P) will be explained with some samples.

TABLE 1

| D | d | d" | r |
|---|---|---|---|
| 450 mm | 433 mm | 593 mm | 76 mm |
| 500 mm | 483 mm | 660 mm | 85 mm |
| 550 mm | 533 mm | 727 mm | 93.5 mm |

TABLE 2

| D | Sectional composition of spring steel | Repulsive power |
|---|---|---|
| 450 mm | 0.8 mm × 6 mm (3 layers) | P ≈ 3.2 kg |
| | 0.8 mm × 7 mm (3 layers) | P ≈ 3.7 kg |
| | 0.9 mm × 6 mm (3 layers) | P ≈ 4.6 kg |
| 500 mm | 1.0 mm × 6 mm (3 layers) | P ≈ 5.0 kg |
| 550 mm | 1.1 mm × 6 mm (3 layers) | P ≈ 5.6 kg |
| | 1.0 mm × 6 mm (4 layers) | P ≈ 5.7 kg |
| | 1.0 mm × 7 mm (4 layers) | P ≈ 6.7 kg |
| | 1.0 mm × 6 mm (5 layers) | P ≈ 7.0 kg |

Figure 20:
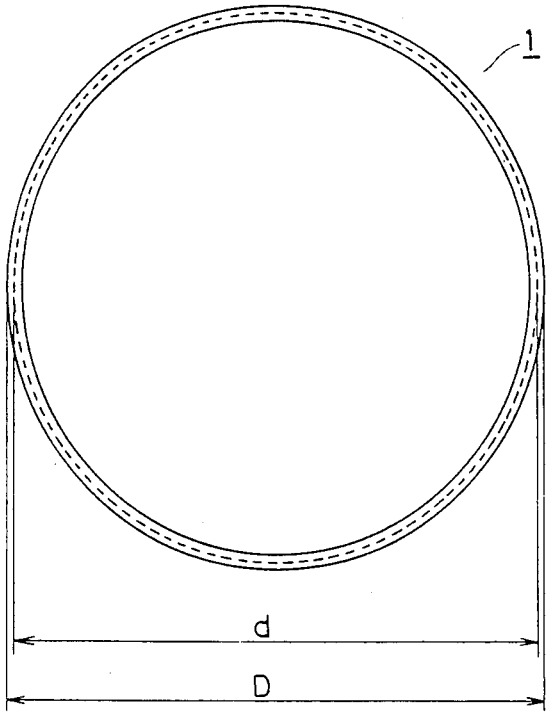
FIGS. 20 and 21 show the circular sporting article of this invention not in use and in a transformed shape respectively.
Figure 21:
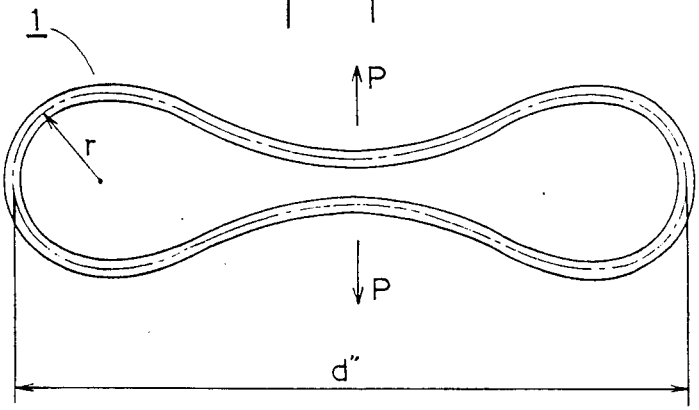

The dimensions shown in Table 1 correspond to those shown in FIGS. 20 and 21 where d is the distance between the core materials at the time the circular sporting article 1 is not in use. FIG. 20 shows the circular sporting article 1 to which no force is applied and FIG. 21 shows that force applied to its center from both sides.

As shown in Table 2, the circular sporting articles 1 having different repulsive power (P) are provided by changing the overall diameter D and the sectional composition of the spring steel 2, and users can select the one that suits themselves, taking into consideration the overall size and repulsive force (P) of each type.

EFFECT OF THE INVENTION

As this invention is composed of the above-mentioned elements, the circular sporting article can be used easily and safely and is convenient for improving physical strength and health. Because of its structure using the long, narrow strip of spring steel as core material, when force is given to the circular sporting article, it will not twist in three dimensions. It can also be used to develop grasping power because the sectional diameter of the covering material is made so that it can easily be grasped by a hand.

Moreover, even if the circular sporting article is restored to the original state against a user's will owing to slipping of his hand or for some other reason, it will do him no harm because of the presence of the covering material.

What is claimed is:

1. A circular sporting article comprising (a) a core material in a ring shape made of concentric adjacent windings of a long and narrow strip of spring steel having two ends, (b) a flexible covering material to cover said circular core material, (c) at least one fitting fixing the two ends of the strip of spring steel with respect to one another, and (d) at least one fitting slidably holding the concentric windings of the strip of spring steel to allow the windings to slide circumferentially with respect to one another, said article having an overall diameter approximately corresponding to the shoulder length of a user and a sectional diameter which can be easily grasped by a user.

2. A circular sporting article as claimed in claim 1 wherein the carbon content of the spring steel is approximately 0.7% and the spring steel is oil-tempered.

3. A circular sporting article as claimed in claim 1 wherein the spring steel is 0.8–1.0 mm in thickness.

4. A circular sporting article as claimed in claim 1 wherein the spring steel is wound in three layers.

5. A circular sporting article as claimed in claim 1 wherein the spring steel forming core material is slidable in the covering material when the spring steel is deformed.

6. A circular sporting article as claimed in claim 1 wherein the flexible covering material is made of synthetic resin or rubber.

7. A circular sporting article as claimed in claim 6 wherein the rubber is compound rubber made of natural rubber and synthetic rubber.

8. A circular sporting article as claimed in claim 1 having a repulsive power of 3–7 kg.

9. A circular sporting article as claimed in claim 1 wherein the overall diameter is 30–60 cm.

10. A circular sporting article as claimed in claim 1 wherein the sectional diameter is 10–20 mm.

11. The circular sporting article of claim 1 wherein there is one fitting fixing the ends of the strip of spring steel, there are three fittings slidably holding the concentric windings of the strip of spring steel, and the four fittings are symmetrically located around the circumference of the core material.

* * * * *